US009269295B2

(12) United States Patent
Kim et al.

(10) Patent No.: US 9,269,295 B2
(45) Date of Patent: Feb. 23, 2016

(54) DISPLAY DEVICE AND DRIVING METHOD THEREOF

(71) Applicant: Samsung Display Co., Ltd., Gyeonggi-Do (KR)

(72) Inventors: In-Hwan Kim, Gyeonggi-Do (KR); Min-Cheol Kim, Gyeonggi-Do (KR); Byung-Geun Jun, Gyeonggi-Do (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 513 days.

(21) Appl. No.: 13/679,916

(22) Filed: Nov. 16, 2012

(65) Prior Publication Data

US 2014/0028649 A1 Jan. 30, 2014

(30) Foreign Application Priority Data

Jul. 25, 2012 (KR) ..... 10-2012-0081299

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2310/0251* (2013.01); *G09G 2310/0262* (2013.01); *G09G 2320/043* (2013.01); *G09G 2330/028* (2013.01); *G09G 2360/16* (2013.01)

(58) Field of Classification Search
USPC ..... 345/76–80
See application file for complete search history.

(56) References Cited

U.S. PATENT DOCUMENTS

| | | | | |
|---|---|---|---|---|
| 8,125,417 | B2 * | 2/2012 | Furuichi | 345/76 |
| 2010/0033409 | A1 * | 2/2010 | Park | 345/76 |
| 2011/0141084 | A1 * | 6/2011 | Kishi | 345/211 |
| 2012/0062545 | A1 * | 3/2012 | Kim | 345/212 |
| 2012/0162177 | A1 * | 6/2012 | Lee | 345/211 |

FOREIGN PATENT DOCUMENTS

| | | | |
|---|---|---|---|
| KR | 10-2009-0004516 | A | 1/2009 |
| KR | 10-2011-0011940 | A | 2/2011 |
| KR | 10-2011-0043082 | A | 4/2011 |
| KR | 10-2012-0000434 | A | 1/2012 |

* cited by examiner

*Primary Examiner* — Roy Rabindranath
(74) *Attorney, Agent, or Firm* — Knobbe, Martens, Olson & Bear, LLP

(57) ABSTRACT

A display device is disclosed. The device includes a display panel including a plurality of pixels, each connected to a corresponding scan line, a corresponding data line, and a corresponding initialization control line and configured to display an image according to a data signal. The device includes an initialization voltage controller to measure a threshold voltage deviation for driving transistors of the pixels, and to set different initialization voltages for the pixels of each of a plurality of regions.

23 Claims, 8 Drawing Sheets

DISPLAY DEVICE AND DRIVING METHOD THEREOF

CROSS-REFERENCE TO RELATED APPLICATIONS

This application claims priority to and the benefit of Korean Patent Application No. 10-2012-0081299 filed in the Korean Intellectual Property Office on Jul. 25, 2012, the entire contents of which are incorporated herein by reference.

BACKGROUND

1. Field

The disclosed technology relates to a display device and a driving method thereof.

2. Description of the Related Technology

Flat panel display apparatuses include a liquid crystal display (LCD), a field emission display, a plasma display panel (PDP), an organic light emitting display device, and the like.

Among the flat panel display apparatuses, the organic light emitting display device displays an image by using an organic light emitting diode which generates light in response to the recombination of electrons and holes. The organic light emitting display device has a rapid response speed and is driven by low power consumption, and has excellent emission efficiency, luminance, and viewing angle, and thus receives attraction.

Generally, the organic light emitting display device is classified as either a passive matrix organic light emitting display device (PMOLED) or an active matrix organic light emitting display device (AMOLED) according to a driving mode of the organic light emitting diode.

The passive matrix type uses a driving mode in which a positive electrode and a negative electrode are formed to be perpendicular to each other and a negative electrode line and a positive electrode line are selectively driven, and the active matrix type is a driving mode in which a thin film transistor and a capacitor are integrated in each pixel to maintain voltage by capacitance. The passive matrix type has a simple structure and is cheap, but it is difficult to implement a large-sized or high-precision panel. In contrast, the active matrix type may be implemented as a large-sized or high-precision panel, but there are problems in that the control method thereof is technically difficult and costs are relatively high.

From the viewpoint of resolution, contrast, and operation speed, the active matrix organic light emitting display device (AMOLED) in which light is selectively emitted for each unit pixel has become mainstream. In one pixel of the active matrix OLED (hereinafter, referred to as an organic light emitting display device), the emission degree of the organic light emitting diode is controlled by controlling a driving transistor which supplies a driving current according to data voltage to the organic light emitting diode.

A difference in threshold voltage and current mobility among a plurality of driving transistors may occur in a display panel of the organic light emitting display device. The difference may occur according to a characteristic of poly-silicon, and manufacturing process, method, and environment of the driving transistor. In addition, the difference may occur due to deterioration of the driving transistor over time of use of the organic light emitting display device.

Although the same data voltage is applied to each pixel circuit, the outputted emission degree or luminosity of the pixel varies due to a nonuniform threshold voltage characteristic of the driving transistor. Accordingly, a spot phenomenon such as relatively dark particles occurs on a bright screen. That is, when the threshold voltages of the driving transistors are not uniform, although the same data voltage is applied, effective gate-source voltage Vgs output of the driving transistor which is directly associated with a driving current supplied to the organic light emitting diode varies. Accordingly, an accurate gray is not expressed according to a data signal and a spot occurs, and as a result, display quality is low.

A technology of compensating an image through compensation of threshold voltage distribution of the driving transistor has been developed, but recently, as a display panel is large-sized and thus a high-speed driving mode is required, it is difficult to sufficiently compensate threshold voltage for all pixels of the display panel.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

One inventive aspect is a display device, including a display panel having a plurality of pixels, each connected to a corresponding scan line of a plurality of scan lines, a corresponding data line of a plurality of data lines, and a corresponding initialization control line of a plurality of initialization control lines. Each pixel is configured to display an image according to a plurality of data signals transferred to the pixels. The display device also includes a scan driver configured to transfer a plurality of scan signals to the plurality of scan lines, a data driver configured to transfer a plurality of data signals to the plurality of data lines, and an initialization voltage controller configured to transfer a plurality of initialization control signals to the plurality of initialization control lines, to measure a threshold voltage variation for driving transistors of the plurality of pixels, and to determine a plurality of initialization voltages for the pixels in each of a plurality of regions. The display device also includes an initialization voltage driver configured to apply one of a plurality of different initialization voltages to each of the pixels of each region, and a signal controller configured to generate and transfer control signals controlling operations of the scan driver, the data driver, and the initialization voltage controller and to supply image data signals for the pixels to the data driver by processing an external image signal.

Another inventive aspect is a method of driving a display device including a plurality of pixels, each including an organic light emitting diode and a driving transistor transferring a driving current according to a data signal to the organic light emitting diode. The method includes initializing a previous frame data voltage written at a gate electrode of the driving transistor, compensating a threshold voltage of the driving transistor, and transferring the data signal to the driving transistor. The method also includes emitting light with the organic light emitting diode in response to the driving current according to the data signal. The initializing includes displaying a sample image by applying a sample initialization voltage and a sample data voltage to the pixels, measuring a threshold voltage deviation for the driving transistors of the pixels by analyzing luminance from the sample image, determining regions according to threshold voltage deviations for the driving transistor, and calculating different initialization voltages for the pixels in each region. The method also includes applying the initialization voltages to the pixels by region.

DETAILED DESCRIPTION OF CERTAIN INVENTIVE EMBODIMENTS

Figure 1:
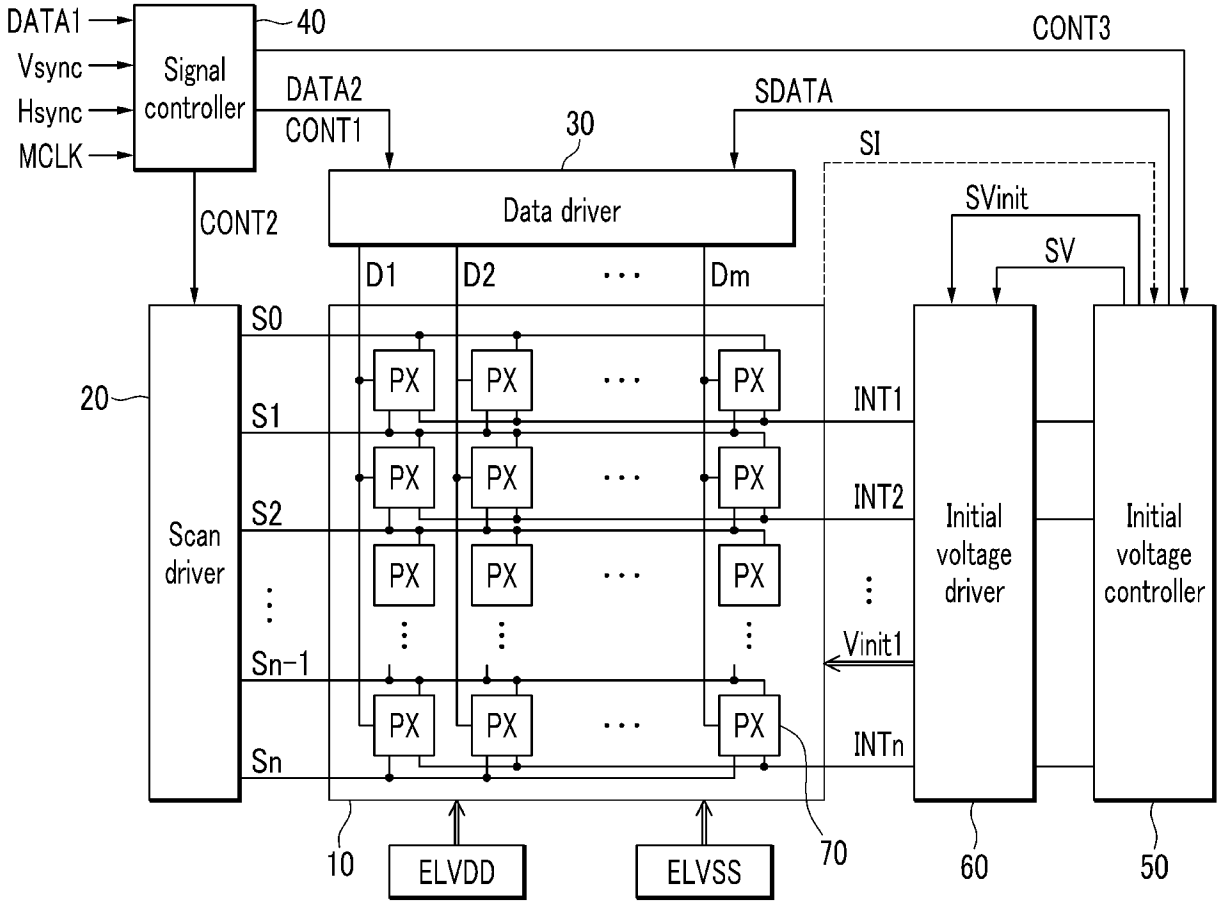
FIG. 1 is a block diagram schematically illustrating a configuration of a display device according to an exemplary embodiment.

Various aspects are described more fully hereinafter with reference to the accompanying drawings, in which exemplary embodiments are shown. As those skilled in the art would realize, the described embodiments may be modified in various ways, without departing from the spirit or scope of the present invention. In order to elucidate the present invention, parts that are not related to the description may be omitted. Like reference numerals generally designate like elements throughout the specification.

Throughout this specification and the claims that follow, when it is described that an element is "coupled" to another element, the element may be "directly coupled" to the other element or may be "electrically coupled" to the other element through a third element. In addition, unless explicitly described to the contrary, the word "comprise" and variations such as "comprises" or "comprising," will be understood to imply the inclusion of stated elements but not the exclusion of any other elements.

FIG. 1 is a block diagram schematically illustrating a configuration of a display device according to an exemplary embodiment. Referring to FIG. 1, the display device includes a display panel 10 including a plurality of pixels 70, a scan driver 20, a data driver 30, a signal controller 40, an initial voltage controller 50, and an initial voltage driver 60.

The display panel 10 includes the plurality of pixels 70 which are disposed in a matrix form in a plurality of regions formed when a plurality of scan lines and a plurality of data lines are perpendicular to each other. The display panel 10 displays an image according to a data signal transferred through the data line.

Each of the plurality of pixels 70 is positioned in a predetermined region near where a plurality of scan lines S1-Sn arranged in one direction and a plurality of data lines D1-Dm arranged in a perpendicular direction to the one direction cross each other. In addition, each of the plurality of pixels is connected with the corresponding scan line among the plurality of scan lines and the corresponding data line among the plurality of data lines. Each of the plurality of pixels displays an image by self-emission of a light emitting element caused by a driving current according to a data signal transferred through the corresponding data line.

Further, according to the exemplary embodiment, as shown in FIG. 1, each of the plurality of pixels may be connected to a corresponding initial control line among a plurality of initial control lines INT1-INTn which extends in parallel in one direction.

Further, although not shown in FIG. 1, according to the exemplary embodiment, each of the plurality of pixels may be connected to a corresponding initial voltage wire among a plurality of initial voltage wires connected to the initial voltage driver 60. In the exemplary embodiment, the initial voltage wire is a wire to which the calculated initial voltage Vinit is applied in order to sufficiently perform compensation according to threshold voltage distribution of a driving transistor of the pixel.

The scan driver 20 is connected with the plurality of scan lines S1-Sn which is connected to each of the plurality of pixels included in the display panel 10. The scan driver 20 responds to a scan control signal CONT2 supplied from the signal controller 40 and generates a scan signal corresponding to each of the plurality of pixels included in the display panel 10 to supply the generated scan signal through the corresponding scan line of the plurality of scan lines S1-Sn.

The data driver 30 is connected with the plurality of data lines D1-Dm which are connected to each of the plurality of pixels included in the display panel 10. The data driver 30 responds to a data driving control signal CONT1 supplied from the signal controller 40. Accordingly, the data driver 30 generates a data signal corresponding to each of the plurality of pixels included in the display panel 10 to supply the generated data signal through the corresponding data line among the plurality of data lines D1-Dm. In detail, an image-processed data signal DATA2 is sampled and latched to be converted into a gamma reference voltage according to a data signal.

According to a driving method of the display device according to the exemplary embodiment, in order to determine an initial voltage transferred to a pixel of the display panel, before an image-processed data signal DATA2 is transferred, a sample data signal SDATA may be applied to the data driver 30. Data voltage according to the sample data signal SDATA through the data driver 30 is transferred to each pixel of the display panel to display a sample image. The signal controller 40 receives and analyzes the image signal DATA1 from the outside and performs the image processing to generate the image data signal DATA2 and transfer the generated image data signal to the data driver 30.

Further, a control signal controlling each driver of the display device is generated to be transferred to the corresponding driver. In detail, the control signal includes a scan control signal CONT2 controlling an operation of the scan driver 20, a data driving control signal CONT1 controlling an operation of the data driver 30, and an initial control signal CONT3 controlling an operation of the initial voltage controller 50. The signal controller 40 receives a vertical synchronization signal Vsync, a horizontal synchronization signal Hsync, a data enable signal DE, a clock signal MCLK, and the like from the outside to generate the control signal. That is, the signal controller 40 may control operation timings of the scan driver 20, the data driver 30, and the initial voltage controller 50 by using timing signals such as the vertical synchronization signal Vsync, the horizontal synchronization signal Hsync, the data enable signal DE, the clock signal MCLK and the like. Since a frame period may be determined by counting the data enable signal DE for 1 horizontal period among the timing signals, the vertical synchronization signal Vsync and the horizontal synchronization signal Hsync which are supplied from the outside may be omitted.

According to the exemplary embodiment of FIG. 1, the display device includes a plurality of initial control lines INT1-INTn connected to each of the plurality of pixels of the display panel 10, and the initial voltage controller 50 is connected to the plurality of initial control lines INT1-INTn. The initial voltage controller 50 generates and transfers an initial control signal corresponding to each of the plurality of initial control lines INT1-INTn in response to the initial control signal CONT3 supplied from the signal controller 40.

In addition, the initial voltage controller 50 is connected to the initial voltage driver 60. The initial voltage driver 60 divides and applies the initial voltage Vinit corresponding to each of the plurality of pixels included in the display panel 10. In this case, the initial voltages Vinit applied by the initial voltage driver 60 are determined for each region according to threshold voltage distribution of a driving transistor of the plurality of pixels included in the display panel. Although not shown in FIG. 1, the initial voltage driver 60 is connected to a plurality of initial voltage wires for transferring the initial voltages Vinit which are differently set for each region to each of the pixels.

In order to determine the initial voltages transferred to the pixels for each region of the display panel, the initial voltage controller 50 measures a threshold voltage deviation characteristic of the driving transistor in the display panel and a distribution characteristic for each display panel region. At least for this purpose, the initial voltage controller 50 displays the sample image on the display panel and acquires image information SI from the sample image.

In order to implement the sample image, the initial voltage controller 50 may set a sample data signal SDATA and sample initial voltage SVinit. The set sample initial voltage SVinit is applied to each pixel included in the display panel 10 in order to measure the threshold voltage distribution characteristic of the driving transistor. The sample initial voltage SVinit is applied through the initial voltage driver 60.

In addition, in order to display the sample image, the initial voltage controller 50 transfers the set sample data signal SDATA to each pixel included in the display panel 10. The sample data signal SDATA is transferred to each pixel through the data driver 30, and each pixel of the display panel 10 displays the sample image in response to the data voltage.

Further, the initial voltage controller 50 acquires and analyzes the image information SI from the sample image displayed on the display panel 10 and then measures a threshold voltage deviation of the driving transistor of the pixel included in the display panel. The image information SI may be luminance information of the sample image when emitting an image at data voltage according to the sample data signal in response to the sample initial voltage.

The initial voltage controller 50 calculates different initial voltage values for each region according to the threshold voltage distribution characteristic of the display panel by using the image information SI.

Initial voltage information SV for the calculated different initial voltage values for each region is transferred to the initial voltage driver 60. The initial voltage driver 60 divides reference voltages based on the initial voltage information SV to supply the initial voltage Vinit corresponding to the plurality of pixels included in each region. The method of applying different initial voltage values to the plurality of pixels included in each region may be implemented in various exemplary embodiments, but as an example, a plurality of initial voltage wires may be provided by a pixel line unit and connected with each pixel to transfer the corresponding initial voltage value.

The region divided according to the distribution characteristic of the threshold voltage of the driving transistor may, for example, be a region of the display panel which has a luminance difference in a range as compared with the target luminance corresponding to the predetermined data voltage and emits light at actual luminance. The predetermined region may be determined by measuring the threshold voltage distribution by using the image information acquired from the sample image in the initial voltage controller 50. That is, the predetermined region may be defined by a pixel unit according to a threshold voltage deviation of the display panel. In addition, according to an exemplary embodiment, the region may be defined by a pixel line unit, a block unit including the plurality of pixel lines, or a unit of all pixels driven for one frame.

Figure 2:
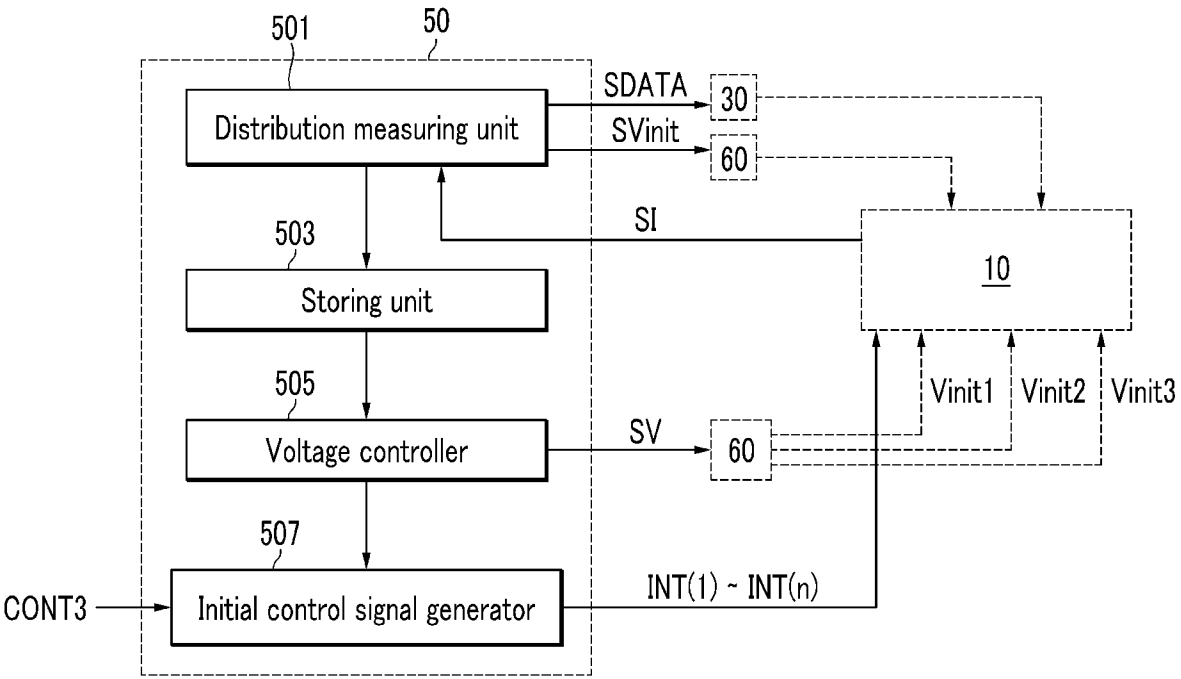
FIG. 2 is a block diagram illustrating a schematic configuration of an initial voltage controller 50 in the display device of FIG. 1.

The initial voltage controller 50 of FIG. 2 is connected to the display panel 10, and is a configured to implement clear and high-grade image quality by compensating an image defect or a gray spot caused by the distribution of the threshold voltages of the driving transistors in the display panel 10. In the exemplary embodiment, the initial voltage controller 50 is connected to the display panel 10 such as the structure shown in FIG. 1 and driven by a mode of differently setting and applying the initial voltages for each region, but it is not limited to the exemplary embodiment. The display panel 10 may be a display panel of an active matrix organic light emitting display device in FIG. 1, but is not limited thereto. Further, the method of transferring the initial voltage to each pixel of the display panel 10 for each region is also not limited.

As an exemplary embodiment, a detailed configuration of the initial voltage controller 50 of FIG. 1 and a driving method for compensating the threshold voltage deviation of the display panel will be described with reference to a block diagram of FIG. 2. Referring to FIG. 2, the initial voltage controller 50 includes a distribution measuring unit 501, a storing unit 503, a voltage controller 505, and an initial control signal generator 507.

The distribution measuring unit 501 is connected with the display panel 10 and measures a threshold voltage deviation (distribution) for a driving transistor of each of the plurality of pixels included in the display panel.

The distribution measuring unit 501 supplies a predetermined voltage set value so that the display panel displays a sample image in order to measure the distribution of the driving transistor of the pixel of the display panel 10. In this case, the supplied voltage set value includes a sample data voltage value of the sample image and a sample initial voltage value. The sample data voltage value is voltage according to a sample data signal SDATA which is transferred to the display panel 10 through the data driver 30. The sample data voltage value according to the sample data signal SDATA is data voltage having the same gray information so that all pixels can emit light at the same predetermined target luminance, as sample data voltage supplied to a data line of each of the plurality of pixels of the display panel.

The sample initial voltage SVinit is transferred to all pixels through the initial voltage driver 60 so as to initialize a driving current of each of the plurality of pixels of the display panel. Since the method of initializing the driving of the pixels included in the display panel may be various according to a characteristic and a kind of the display panel, the method of applying the sample initial voltage is also not particularly limited. Like the exemplary embodiment of the present invention, in the case where the pixel is a self-emission element such as an organic light emitting diode, the sample initial voltage may be applied to a control element (driving transistor) so as to initialize the driving current transferred to the organic light emitting diode to a predetermined value.

When the distribution measuring unit 501 transfers set values for a predetermined sample data voltage value and the predetermined sample initial voltage value to the display panel 10, the display panel 10 is initialized to the sample initial voltage and then displays an image according to sample data voltage. The display panel 10 is driven by a driving power supplied from the outside and displays an image according to a sample data voltage after initializing respective pixels by using set values transferred from the distribution measuring unit 501.

The distribution measuring unit 501 acquires sample image information SI for the sample image displayed in the display panel 10. That is, the distribution measuring unit 501 analyzes luminance of the sample image displayed in the display panel 10. In detail, in an image in which each pixel of the display panel 10 emits light, the distribution measuring unit 501 measures which value actual luminance has as compared with target luminance corresponding to the sample data voltage value. The target luminance may, for example be a target or expected or ideal luminance when light is emitted according to gray information corresponding to the sample data voltage.

The distribution measuring unit 501 repetitively analyzes luminance from the sample image of the display panel while controlling values of the sample data signal SDATA and the sample initial voltage SVinit. When the distribution measuring unit 501 repetitively analyzes luminance in the sample image of the display panel, all driving conditions and driving times of the display panel are equally fixed except for the set values transferred from the distribution measuring unit. That is, the repetitive sample images are displayed while a driving environment such as an external driving power, a pixel circuit structure, a wire and the like and a driving time such as an initializing time, a threshold voltage compensation time, a scan and data writing time, a light emission time and the like are constantly fixed at all times.

Then, the sample image is repetitively displayed in the display panel 10 and thus gray information and set voltage values which are acquired through a process of analyzing the luminance of the sample image in the distribution measuring unit 501 are transferred and stored to the storing unit 503.

The storing unit 503 is connected to the distribution measuring unit 501 and receives image information for the sample image of the display panel from the distribution measuring unit 501 to store the image information in a lookup table form. The lookup table stored in the storing unit 503 represents a relationship of gray information changed as the initial voltage applied to the pixel of the display panel is changed, as a gray value which is actually displayed in the display panel in response to the sample data voltage having a predetermined luminance value.

The voltage controller 505 sets initial voltage for compensating threshold voltage distribution of a plurality of driving transistors when the display panel actually displays an image according to an external image signal. In this case, the voltage controller 505 uses a lookup table of gray information relationship for the initial voltage of the display panel stored in the storing unit 503.

That is, since the threshold voltage characteristic of the driving transistor of each pixel of the display panel is different, the gray spot may occur in an image according to the sample data voltage. The occurrence degree of the gray spot is influenced by a deviation between the target luminance of the sample data voltage and the actual luminance.

Accordingly, in the case where a predetermined critical range of the target luminance is set and the actual luminance exceeds the critical range, a region, in which initial voltage is differently set by a block unit binding the corresponding pixels of the display panel by a pixel unit, a pixel line unit, or a pixel group, or by a frame unit, is determined. The threshold voltage distribution of the driving transistor of the pixel may be grouped according to a degree at which the actual luminance exceeds the critical range of the target luminance. That is, levels in which the actual luminance exceeds the critical range of the target luminance are grouped such that characteristics of the threshold voltages of the driving transistors of the pixels which belong to each group are similar to each other.

The voltage controller 505 may determine an initial voltage for each region (e.g., for each pixel, for each line, for each block, of for each frame). That is, the distribution measuring unit 501 may determine an initial voltage of the corresponding region at a level in which the gray spot does not occur when the image of the display panel is displayed by varying the initial voltage. Herein, the occurrence of the gray spot may be, for example, that the threshold voltage of the driving transistor of the pixels included in the corresponding region (pixel, line, block, or frame region) is not sufficiently compensated and thus a luminance deviation exceeds a limit.

As a result, the voltage controller 505 may determine a region of initial voltage control of the display panel and then determine initial voltage just before the gray spot occurs for each region by using a lookup table as an actually applied initial voltage value. The initial voltage value which is differently determined for each region is set as initial voltage information SV to be transferred to the initial voltage driver 60.

As an example, when respective gray spots are differently expressed in a pixel line 1, a pixel line 2, and a pixel line 3 although the same sample data voltage is applied in a test of the display panel, the voltage controller 505 may set a control target region of the initial voltage by a pixel line unit and may determine initial voltage applied to each pixel line.

That is, since the threshold voltages of the driving transistors of the pixels included in the pixel line 1, the pixel line 2, and the pixel line 3 are different from each other, although the display panel is driven by the same compensation for the same driving time, gray spots of images displayed for each pixel line differently occur. For example, when sample initial voltage is applied at 1 V, the pixels of the pixel line 1 and the pixel line 2 have threshold voltages in the range of −1 to 1V and thus the threshold voltages are sufficiently compensated for a predetermined compensation period, while the pixels of the pixel line 3 have threshold voltages in the range of −1V or less and thus the threshold voltages are not compensated for the compensation period. Accordingly, in the case where all of the pixels of the panel are equally initialized at initial voltage of 1V, the image is not displayed at accurate luminance in a region of the pixel line 3 and thus a spot occurs.

As a result, the voltage controller 505 may separately determine initial voltages so that all of the threshold voltages are compensated for the same compensation period for each pixel line. That is, by using the lookup table of the storing unit 503, in the case of the region of the pixel line 3 in the example, when the initial voltage is gradually applied to be lower than 1 V, a voltage value (for example, −1V) at which the gray spot does not occur may be found even for the same compensation period and the voltage value may be set as an initial voltage value applied to the pixel of the pixel line 3.

A method of determining the initial voltage in the voltage controller 505 is described as an example and embodiments are not limited thereto, and may be determined according to a form of a set region in which the initial voltage is differently supplied.

That is, if the initial voltage is differently supplied by a pixel unit, the initial voltage of the corresponding pixel may be obtained by using the lookup table of the storing unit 503.

If the initial voltage is differently supplied by a line unit or a block unit included in the plurality of pixel lines, the voltage controller 505 determines a plurality of initial voltages for the plurality of pixels included in the corresponding line or block by using the lookup table and then may determine the initial voltage as an average value, a maximum value, minimum value, or an intermediate value for the plurality of initial voltages. If the initial voltage is differently supplied by a frame unit, the voltage controller 505 determines initial voltages of all pixels of the display panel by using the lookup table and then may determine the initial voltage as an average value, a maximum value, minimum value, or an intermediate value.

Figure 3:
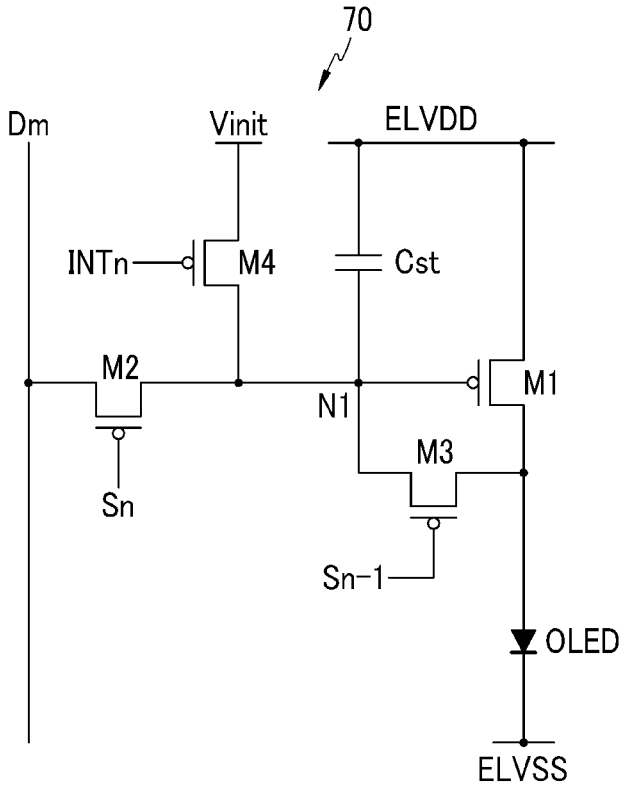
FIG. 3 is a circuit diagram illustrating a configuration of a pixel 70 included in the display device of FIG. 1.

In the exemplary embodiment, the transistor in the pixel included in the display panel is a PMOS transistor as shown in FIG. 3. In addition, a method of initializing the pixel includes applying the initial voltage to gate voltage of the PMOS driving transistor of the pixel.

Accordingly, in the exemplary embodiment, the content for the relationship between the threshold voltage and the initial voltage is described by assuming the constituent element of the pixel as the PMOS. However, in the case where the pixels use NMOS transistors, while the initial voltage values are gradually increased in the lookup table, a voltage value suitable for the compensation of the corresponding region is used.

After the voltage controller 505 differently determines the initial voltage values for each set region of the display panel, the initial voltage information SV including the plurality of initial voltage values for each region is transferred to the initial voltage driver 60. Then, the initial voltage driver 60 supplies the set initial voltage for each set region to the pixel of the corresponding set region.

In the exemplary embodiment, the initial voltage driver 60 may include a digital-analog voltage converter (DAC), and may be formed by an R-string in which a plurality of resistors are connected to each other in series between reference voltage and ground voltage.

A form of supplying the different initial voltages for each set region of the display panel 10 in the initial voltage driver 60 may vary according to a set region unit. That is, the initial voltage may be supplied through a separate initial voltage wire (not shown) according to a set region unit of the display panel. In addition, the initial voltage may be supplied for a time different from the data writing time by using the data line which is disposed in the related art.

The method of outputting each initial voltage of the initial voltage driver 60 and the supplying form to the display panel is not limited.

For example, in the case where a basic unit of the set region is each pixel, the voltage controller 505 determines the initial voltage value applied for each pixel. Then, the initial voltage driver 60 outputs the different initial voltages to the respective pixels through a voltage division. The supplying method used for the initial voltages which are differently determined for each pixel is not limited, but in the case where the set region is a pixel unit, the data line connected to each pixel may be used.

In the case where the basic unit of the set region is a pixel line or a block including the plurality of pixel lines, the initial voltage driver 60 may supply the initial voltages through the initial voltage wires formed in the line unit. For example, referring to FIG. 2, in the case where the initial voltage is supplied to three groups, in the voltage controller 505, first initial voltage Vinit1, second initial voltage Vinit2 and third initial voltage Vinit3 which are different from each other are generated and supplied to the three groups.

Further, the basic unit of the each region may be, for example, a frame unit, and in this case, the initial voltage values transferred to the entire display panel 10 may be differently set and applied for each frame. In this case, the initial voltage driver 60 outputs the initial voltages to the display panel for every frame.

The initial voltage controller 50 further includes an initial control signal generator 507 which generates and transfers a plurality of initial control signals INT(1)-INT(n), in addition to the constituent elements which perform the setting of the initial voltage and the calculating of the initial voltage for each region. The initial control signal generator 507 generates and transfers an initial control signal corresponding to each of the plurality of initial control lines INT1-INTn which is connected to each of the plurality of pixels of the display panel.

The initial control signals INT(1)-INT(n) control timings for transferring the determined initial voltages which are controlled as different values for each region of the display panel in the voltage controller 505 to the pixels for each region of the display panel. That is, each of the pixels for each region of the display panel receives a voltage determined as the initial voltage for the pixel in response to the initial control signal corresponding to the pixel.

FIG. 3 is a circuit diagram illustrating an exemplary structure of the pixel of the display panel to be a compensation target of the threshold voltage distribution according to the exemplary embodiment. Referring to FIG. 3, the pixel includes an organic light emitting diode (OLED) and a driving circuit driving the organic light emitting diode (OLED), and the driving circuit is configured by four transistors M1 to M4 and one capacitor Cst. However, the circuit structure of FIG. 3 is just one example, and the present invention is not limited to the circuit structure.

The pixel circuit of FIG. 3 is positioned in a region in which an n-th scan line Sn, a n−1-th scan line Sn-1, an n-th initial control line INTn and an m-th data line Dm cross each other in the display device of FIG. 1, and relates to a pixel 70 connected with the wire. Further, in the exemplary embodiment of FIG. 3, the pixel circuit is connected to an initial voltage wire which receives the corresponding initial voltage.

The pixel circuit may have a 6TR1CAP structure configured by six transistors and one capacitor by adding at least one light emission control transistor which controls a driving current flowing into the organic light emitting diode (OLED) by an additional light emission control signal to the pixel circuit of FIG. 3.

The image compensation of the display panel configured by the pixel like the exemplary embodiment of FIG. 3 is performed by controlling the initial voltage applied to a gate terminal of the driving transistor which transfers the driving current of the organic light emitting diode (OLED).

In detail, the pixel of FIG. 3 includes an organic light emitting diode (OLED) and a driving transistor M1 transferring a driving current to the organic light emitting diode (OLED). In addition, the pixel of FIG. 3 includes a switching transistor M2, a threshold voltage compensation transistor M3, an initial transistor M4, and a storage capacitor Cst.

The driving transistor M1 includes a gate electrode connected to a first node N1, a first electrode connected to a supply source of a driving power source voltage ELVDD of a high level supplied from the outside, and a second electrode connected to an anode electrode of the organic light emitting diode (OLED). When the driving transistor M1 is turned on, the driving current of the data voltage according to a data signal written by the first node N1 is transferred to the organic light emitting diode (OLED) to emit light at predetermined luminance.

The switching transistor M2 includes a gate electrode connected to the corresponding n-th scan line Sn among a plurality of scan lines, a first electrode connected to the corresponding m-th data line Dm among a plurality of data lines, and a second electrode connected to the first node N1. When the switching transistor M2 is turned on, data voltage Vdata according to a data signal is transferred to the first node N1 connected to the gate electrode of the driving transistor M1 through the data line Dm.

The threshold voltage compensation transistor M3 includes a gate electrode connected to the n−1-th scan line Sn-1 which is a scan line of the previous pixel line of the pixel line in which the corresponding pixel 70 is positioned, a first electrode connected to the first node N1 to which the gate electrode of the driving transistor M1 is connected, and a second electrode connected to the second electrode of the driving transistor M1. The n−1-th scan line Sn-1 transfers a scan signal S(n−1) of the previous pixel line in order to control the compensation of the threshold voltage of the driving transistor M1.

As another exemplary embodiment, the display device may further include a plurality of control lines connected to the plurality of pixels and a gate driver supplying compensation control signals to the plurality of control lines. In the exemplary embodiment, the gate electrode of the threshold voltage compensation transistor M3 of each pixel is connected to the corresponding control line among the plurality of control lines. As a result, the corresponding compensation control signal is received through the corresponding control line, and a switching operation may be controlled in response thereto.

Referring back to the exemplary embodiment of the present invention of FIG. 3, a detailed operation will be described. When the threshold voltage compensation transistor M3 is turned on in response to the n−1-th scan signal S(n−1) applied through the n−1-th scan line Sn-1 before the corresponding scan signal S(n) is transferred though the n-th scan line Sn, the second electrode is diode-connected with the gate electrode of the driving transistor M1 so that the driving transistor M1 becomes a diode. Then, the gate electrode and the drain electrode of the driving transistor M1 are diode-connected to each other, and a voltage value corresponding to the threshold voltage of the driving transistor is charged in the storage capacitor Cst. As a result, the threshold voltage deviation is compensated due to the threshold voltage of each driving transistor which is pre-charged when the data voltage according to an image signal is applied to emit light at luminance according to accurate data voltage.

Meanwhile, the initial transistor M4 includes a gate electrode connected to an n-th initial control line INTn, a first electrode connected to the initial voltage wire which supplies an initial voltage Vinit calculated according to the distribution characteristic of the corresponding pixel 70, and a second electrode connected to the first node N1.

The n-th initial control line INTn transfers, to the gate electrode of the initial transistor M4, an initial control signal INT(n) which controls supplying of the initial voltage Vinit for initializing the previously written data voltage in a driving process of writing the data of the driving transistor M1 and displaying the written data. When the initial transistor M4 is turned on in response to the initial control signal INT(n), the initial voltage Vinit is applied to the gate electrode of the driving transistor M1 to initialize the previous data voltage written in the gate electrode of the driving transistor M1.

The storage capacitor Cst includes one electrode connected to the supply source of the driving power source voltage ELVDD connected to the first electrode of the driving transistor M1 and the other electrode connected to the first node N1. Since voltage according to a voltage difference applied to the both electrodes is charged in the storage capacitor Cst, voltage by a difference between the voltage changed according to a change in the voltage applied to the first node N1 and the driving power source voltage ELVDD is maintained for a predetermined period.

The transistor configuring the pixel in FIG. 3 is a PMOS transistor, but it is just one example and the transistor may be configured by an NMOS transistor. Accordingly, gate on voltage which turns on the transistor in FIG. 3 has a predetermined low level, but if a kind of the constituent transistor is changed, the gate on voltage level is reversed.

A driving process of the organic light emitting diode (OLED) using the configuration of the pixel according to the exemplary embodiment of FIG. 3 will be described with reference to a timing diagram of FIG. 4.

First, at a time t1, the initial control signal INT(n) is converted into a predetermined low level which is a gate on level of the transistor to be applied to the gate electrode of the initial control transistor M4 of the pixel 70 of FIG. 3. Then, the initial transistor M4 of the pixel is turned on, and the initial voltage Vinit determined in response to the pixel 70 is applied to the first node N1.

The storage capacitor Cst is charged as a voltage value corresponding to the previous data voltage and then is gradually discharged by the initial voltage Vinit applied to the other electrode of the storage capacitor Cst connected to the first node N1. That is, the charged voltage of the storage capacitor Cst is changed from the voltage corresponding to the previous data voltage to the voltage by a voltage difference applied to both terminals of the storage capacitor Cst, that is, a difference between the driving power source voltage ELVDD and the initial voltage Vinit.

Next, at a time t2, the n−1-th scan signal S(n−1) is converted to a low level which is a gate on voltage level to be transferred to the n−1-th scan line which is the previous scan line of the pixel 70.

The n−1-th scan signal S(n−1) is applied to the gate electrode of the threshold voltage compensation transistor M3 of the pixel 70. When the threshold voltage compensation transistor M3 is turned on in response to the n−1-th scan signal S(n−1) of the low level, the gate electrode and the second electrode of the driving transistor M1 are diode-connected to each other. When the gate electrode and the second electrode of the driving transistor M1 are connected to each other, the driving transistor serves as a diode and thus threshold voltage Vth of the driving transistor M1 is applied to the first node N1.

Then, the storage capacitor Cst is maintained as a voltage value corresponding to the initial voltage Vinit and the discharged as a voltage value corresponding to the threshold voltage Vth of the driving transistor M1. In the exemplary embodiment of the present invention, the compensation time for compensating the threshold voltage means a time at which the storage capacitor Cst is charged to the voltage corresponding to the initial voltage at the time t1 and then discharged to the voltage corresponding to the threshold voltage of the driving transistor at the time t2.

Accordingly, according to the exemplary embodiment, when the initial voltage Vinit is differently set and applied every pixel for each region as a value corresponding to the threshold voltage of the driving transistor M1, the compensation of the threshold voltage of the pixel may be sufficiently performed for the same compensation time.

Next, at a time t3, the n-th scan signal S(n) is converted into a low level which is a gate on voltage level to be transferred to the n-th scan line which is the corresponding scan line of the pixel 70.

The n-th scan signal S(n) of the low level is transferred to the gate electrode of the switching transistor M2 of the pixel 70, and the switching transistor M2 is turned on. Then, the data voltage Vdata according to a data signal is applied to the first electrode of the switching transistor M2 through the data line Dm to be transferred to the first node N1.

The storage capacitor Cst is maintained as a voltage value corresponding to the data voltage Vdata according to the data signal for a data writing period Data. When the voltage level of the n-th scan signal S(n) is increased to a high level at the ending time of the data writing period Data, the switching transistor M2 is turned off. Then, the driving transistor M1 emits light by flowing the driving current corresponding to the voltage corresponding to a voltage difference between both terminals of the gate electrode and the source electrode, that is, the voltage maintained in the storage capacitor Cst into the organic light emitting diode (OLED).

Although the threshold voltages of the driving transistors are different from each other due to a characteristic of the pixel, since the threshold voltages are sufficiently compensated in advance before the data writing, the light may be emitted at accurate luminance according to the data voltage Vdata, regardless of the threshold voltage characteristic.

Figure 4:
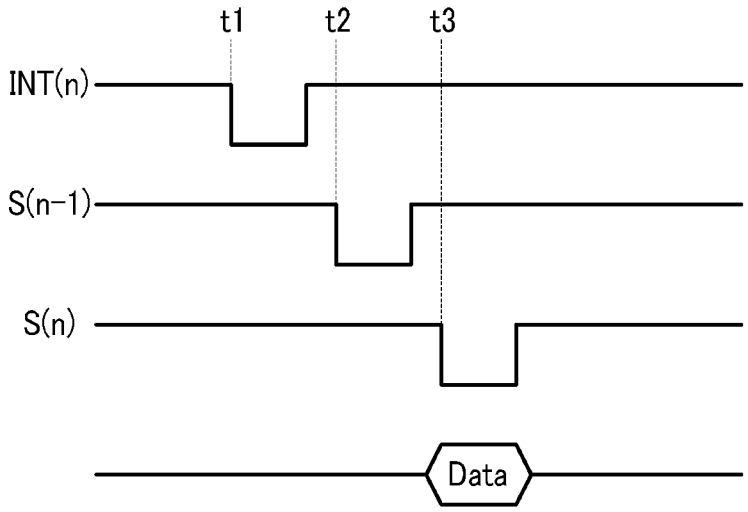
FIG. 4 is a signal timing diagram illustrating driving of a pixel circuit of FIG. 3.

An applying process of the initial voltage and a compensating process of the threshold voltage of the pixel according to the exemplary embodiment in the driving process of FIGS. 3 and 4 is described in detail with reference to graphs of FIGS. 5 and 6.

Figure 5:
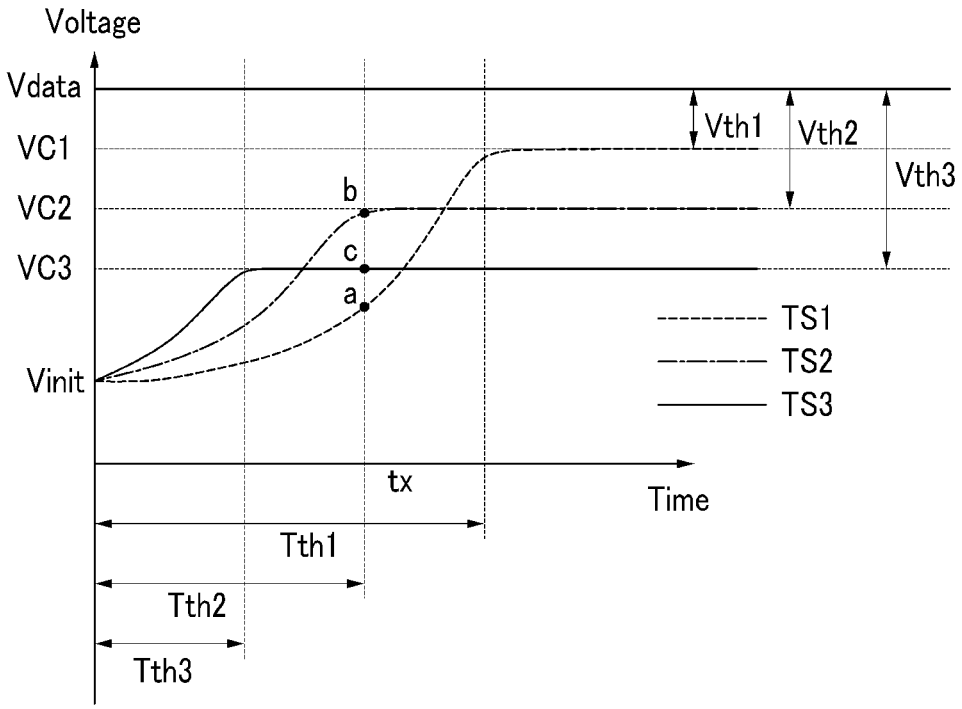
FIG. 5 is a graph illustrating a relationship between threshold voltage distribution and a compensation time of a driving transistor of a pixel in a display device.

FIG. 5 is a graph illustrating a relationship between threshold voltage distribution and a compensation time of a driving transistor.

A first pixel TS1, a second pixel TS2, and a third pixel TS3 are exemplified, in which a threshold voltage characteristic of a driving transistor is not uniform according to one or more of a characteristic, a manufacturing process, a method, and an environment of polysilicon of a base substrate of the pixel. The first pixel TS1 to the third pixel TS3 are included in one display panel.

In the exemplary embodiment, since transistors of the pixels are exemplified as PMOSs, the PMOS will be mainly described. Accordingly, in a graph of FIG. 5, predetermined data voltage Vdata may be variable in a minus value. That is, in the graph of FIG. 5, an increase of a Y-axis represents that an absolute value is increased in a minus area.

In addition, threshold voltage of the driving transistor of the first pixel is VC1 which is close to the predetermined data voltage Vdata, threshold voltage of the driving transistor of the second pixel TS2 is VC2, and threshold voltage of the driving transistor of the third pixel TS3 is VC3. Accordingly, differences between the predetermined data voltage Vdata and the threshold voltage values of the driving transistors of the first to third pixels are Vth1, Vth2, and Vth3.

In order to compensate the threshold voltage of each driving transistor, a gate electrode and a drain electrode of the driving transistor are diode-connected with each other and thus gate electrode voltage needs to be maintained at the respective corresponding threshold voltage values VC1 to VC3.

However, as described above, the initial voltage before compensation of the threshold voltage in the driving of the pixel of FIGS. 3 and 4 is applied to the gate electrode of the driving transistor.

As shown in the graph of FIG. 5, the initial voltage Vinit is applied. As a result, a compensation period in which the initial voltage Vinit drops to the threshold voltages VC1 to VC3 of respective driving transistors of the first to third pixels varies. That is, in the driving transistor of the first pixel, a compensation time taken when a current flows out from the initial voltage Vinit to the threshold voltage VC1 is the longest as Tth1. On the contrary, in the driving transistor of the third pixel, a compensation period taken when a current flows out from the initial voltage Vinit to the threshold voltage VC3 is the shortest as Tth3. The compensation times Tth1 to Tth3 vary according to the threshold voltage characteristic of the driving transistor.

When the display device is driven at high speed and thus a sufficient compensation time is not ensured and the threshold voltage is compensated for the same predetermined reference compensation time tx, a gate voltage value of the driving transistor of the second pixel reaches b and a gate voltage value of the driving transistor of the third pixel reaches c, and as a result, each threshold voltage is sufficiently compensated. However, a gate voltage value of the driving transistor of the first pixel reaches a, and thus the threshold voltage is not compensated.

Thus, when the data voltage according to the data signal is applied to the first pixel TS1, voltage different from intended data voltage is outputted and thus the emission degree is different from that of other pixel of the display panel. As a result, the display device of the exemplary embodiment differently sets and applies voltage values of the initial voltage Vinit applied to the gate electrode of the driving transistor of the pixel for each region in response to the threshold voltage of the driving transistor.

Figure 6:
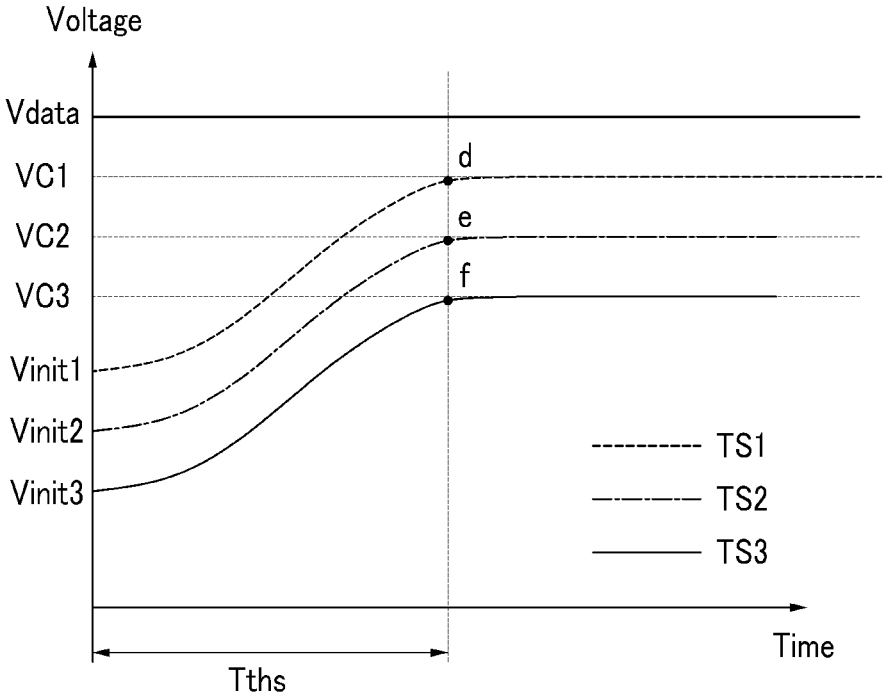
FIG. 6 is a graph illustrating a compensation degree of threshold voltage of a driving transistor in the case of applying a driving method according to an exemplary embodiment.

FIG. 6 is a graph illustrating compensation of threshold voltage of a driving transistor, in the case of applying a driving method of the display device according to an exemplary embodiment shown in FIG. 5. The initial voltage is differently set in response to the threshold voltage of the driving transistor of each of the first pixel to the third pixel TS1 to TS3 in the voltage controller 505 included in the initial voltage controller 50 of the display device. That is, initial voltage Vinit1 applied to the first pixel TS1, initial voltage Vinit2 applied to the second pixel TS2, and initial voltage Vinit3 applied to the third pixel TS3 are differently set in response to the threshold voltage of the driving transistor of each pixel.

Each of the initial voltages Vinit1 to Vinit3 which are differently set in the voltage controller 505 may be controlled so that a gate voltage value of the driving transistor of each pixel is maintained at a sufficient voltage value to compensate each threshold voltage at the time when a predetermined compensation time Tths ends. That is, each of the initial voltages Vinit1 to Vinit3 may be controlled so that voltage Vgs between gate-source of the driving transistor of each pixel is in the same range at the time when the predetermined compensation time Tths ends.

In detail, in the example of FIG. 6, the initial voltage Vinit1 is set to a low voltage as compared with initial voltage of another pixel so that the initial voltage Vinit1 applied to the first pixel TS1 may sufficiently reach a voltage value d of the threshold voltage VC1 of the driving transistor of the first pixel TS1 for the compensation time Tths. The initial voltage Vinit2 applied to the second pixel TS2 is set so as to sufficiently reach a voltage value e of the threshold voltage VC2 of the driving transistor of the second pixel TS2 for the compensation time Tths. Further, the initial voltage Vinit3 applied to the third pixel TS3 is set as high voltage as compared with the initial voltage of another pixel so as to sufficiently reach a voltage value f of the threshold voltage VC3 of the driving transistor of the third pixel TS3 for the compensation time Tths.

As shown in FIG. 6, in order to sufficiently compensate the threshold voltage of the driving transistor of each pixel for the same compensation time Tths, by differently setting and applying the initial voltages such as the first initial voltage Vinit1, the second initial voltage Vinit2, and the third initial voltage Vinit3, the gate-source voltage Vgs of each driving transistor is outputted to the same value for the same data voltage and thus the driving current is determined. Accordingly, although the threshold voltages of the driving transistors of the pixels of the display panel are differently distributed, the driving current according to the same data signal is equally determined to be displayed at predetermined luminance during light emission and the spot phenomenon is prevented.

In FIGS. 5 and 6, the first to third pixels represent respective pixels having different threshold voltages of the driving transistor, but are not limited thereto and may represent a plurality of corresponding pixels for each pixel line, for each block, and for each frame.

Figure 7:
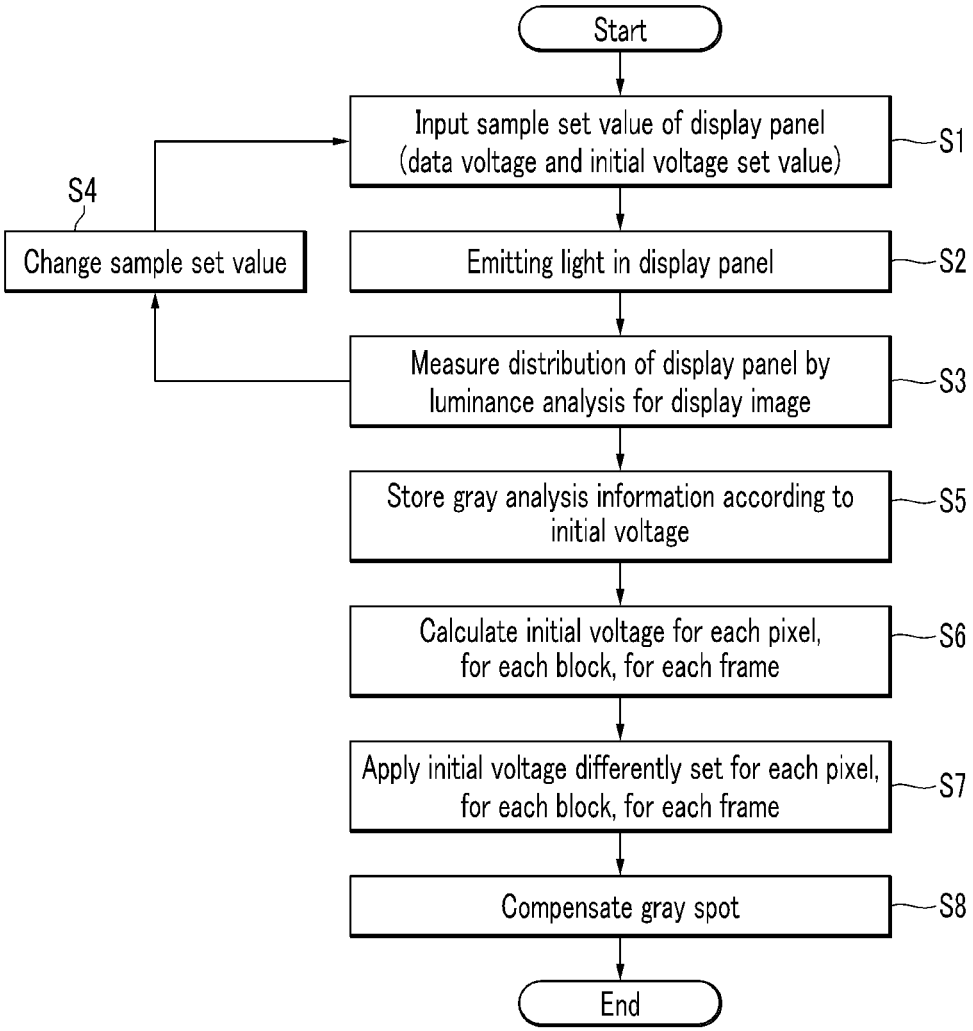
FIG. 7 is a flowchart illustrating a driving method of a display device according to another exemplary embodiment.

FIG. 7 is a flowchart illustrating a driving method of a display device according to another exemplary embodiment.

First, a sample set value for the display panel is inputted (S1). The sample set value may be a predetermined data voltage set value which is applied to each pixel and a predetermined initial voltage set value in order to measure the threshold voltage distribution of the driving transistors of the pixels included in the display panel. Each pixel of the display panel is driven by receiving the sample set value to emit light at predetermined luminance (S2). That is, after each pixel of the display panel is initialized at the same voltage by the sample initial voltage set value, the each pixel emits light at the driving current corresponding to the sample data voltage to display a sample image.

In this case, the threshold voltage distribution of the driving transistor of each pixel of the display panel is measured by performing a luminance analysis for the display image of the display panel (S3). That is, target luminance according to the sample data voltage is determined, but the light is emitted at actual luminance as the threshold voltage of the driving transistor of each pixel in the display panel is different. In step S3, by setting a predetermined critical range of the target luminance and measuring the actual luminance, a degree of exceeding the critical range is measured to be analyzed for each region.

The analyzing process may be repetitively performed while differently changing set values of the sample initial voltage and the sample data voltage (S4). That is, step S1 to step S3 may be repetitively performed while changing the sample set value. For example, while the initial voltage is increased or decreased in the range of −2 V to 0 V with a regular interval according to a gray of a sample data signal, an expression degree of a spot in the panel may be checked by displaying the sample image of the display panel.

Information analyzed for each gray level of the data signal may be stored in a lookup table form while differently setting the sample initial voltages (S5). The stored analysis information is a table relating to whether the image of the sample data according to the sample initial voltage is actually displayed with any gray value.

The initial voltage applied for each pixel, for each block, or for each frame is calculated by using the gray analysis information according to the initial voltage stored in the storing unit (S6). In this case, the calculated initial voltage may be determined at a level in which the gray spot does not occur when the image of the display panel is displayed while varying the sample initial voltage value. Here, the block means a pixel area included in at least one pixel line.

A reference region which differently applies the initial voltage may be determined according to information analyzed in the distribution measuring process of the display panel. That is, whether different initial voltages are applied for each pixel, for each block, or for each frame according to an analysis pattern of the display panel displayed at actual luminance in response to target luminance may be determined.

The reference region is determined and then differently set initial voltages are applied for each pixel, for each block, or for each frame (S7). As described above, the exemplary embodiment in which the initial voltage is applied for each pixel and the exemplary embodiment in which the initial voltage is applied for each block and for each frame may be different from each other.

In step S7, when the initial voltages are differently applied according to the distribution of the threshold voltage, the threshold voltages of different driving transistors may be sufficiently compensated even for a predetermined compensation time which may not be limited in a high-speed driving. Accordingly, the gray spot of the display panel is compensated (S8) to implement a high-quality display.

Figure 8:
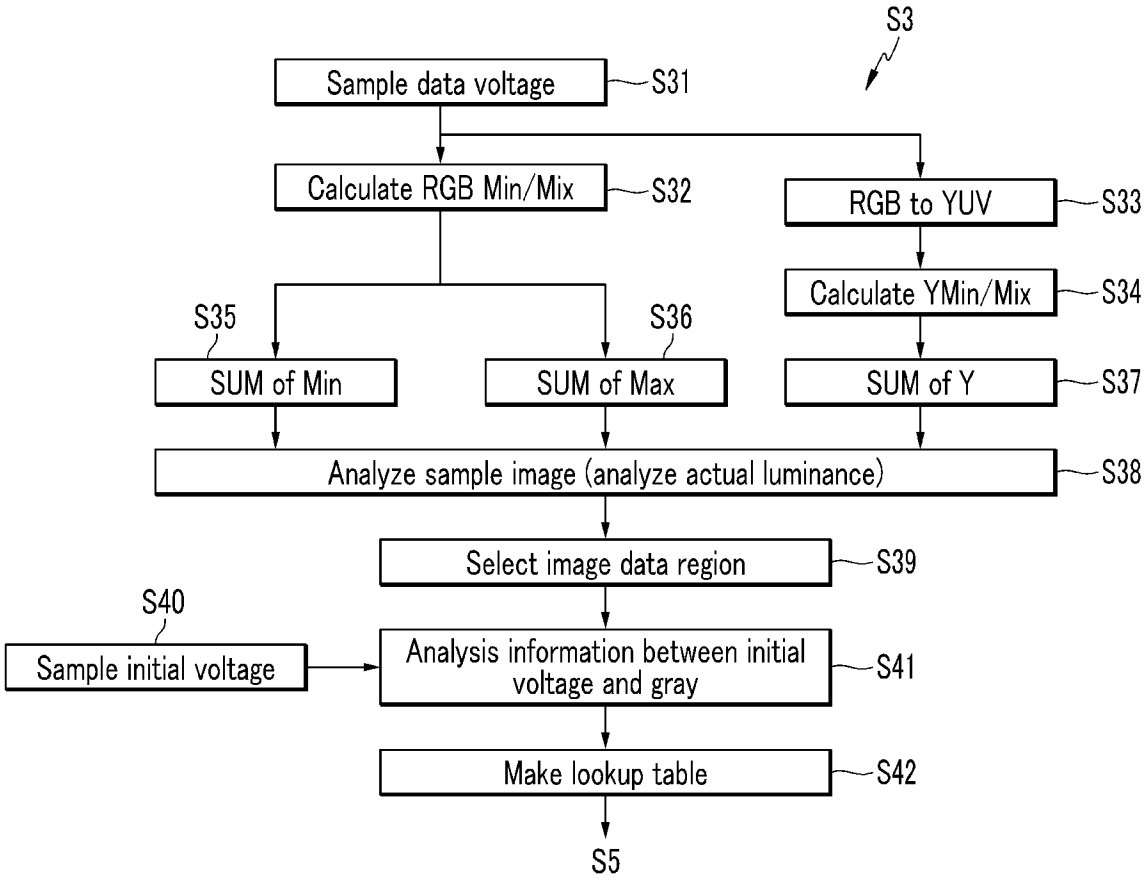
FIG. 8 is a flowchart illustrating a distribution measuring process of the display panel which is performed in step S3 among processes of FIG. 7.

FIG. 8 is a flowchart illustrating a distribution measuring process of the display panel which is performed in step S3 of the processes of FIG. 7 in detail. Step S3 may be performed in the distribution measuring unit 501 of the initial voltage controller 50 as described above.

In detail, the sample data voltage is received (S31), and a maximum gray Max value and a minimum gray Min value are calculated for each color of RGB of the pixel in information of sample data signal (S32). In addition, a sum (S35) of minimum gray Min values for each color and a sum (S36) of maximum gray Max values for each color are calculated.

Further, an RGB data image is converted from the sample data signal information to a YUV color system (S33). The minimum Min and maximum Max values of a luminance component Y are calculated by using the sample data signal information converted to the YUV color system (S34). In addition, a sum of luminance components Y of the sample data signal is obtained by using the calculated values (S37).

A target luminance value corresponding to the sample data signal may be calculated by using the sum of the minimum grays and the maximum grays for each color of RGB acquired in steps S35, S36, and S37 and the sum of the luminance components. Actual luminance is analyzed in the sample image based on a target luminance value corresponding to the sample data signal (S38).

Regions may be divided according to a shifted degree in the target luminance range bases on the actual luminance value outputted in the display image of the sample data as the analyzed result (S39). A threshold voltage deviation of the driving transistor of the pixel included in each divided region of the display panel may be generated.

Thereafter, the sample initial voltage value is inputted (S40) and analysis information between grays of the initial voltage and the sample image data may be acquired (S41).

The analysis information between the initial voltage and the gray may be made in a lookup table form (S42).

When the information of the initial voltage and the gray voltage according to the data signal is stored in the lookup table in the distribution measuring unit of the display device like step S3, step S4 is performed and the initial voltage is determined and supplied according to the threshold voltage distribution of the driving transistor of each pixel.

The drawings referred to in the above illustrate certain embodiments and aspects of the present invention, and are not intended to restrict the meanings or the scope of the present invention. Therefore, those skilled in the art can select and modify the drawings and disclosed description. Those skilled in the art can omit some of the constituent elements described in the present specification without deterioration in performance thereof or can add constituent elements to improve performance thereof. Furthermore, those skilled in the art can modify the sequence of the steps of the method described in the present specification depending on the process environment or equipment.

What is claimed is:

1. A display device, comprising:

a display panel including a plurality of pixels, each connected to a corresponding scan line of a plurality of scan lines, a corresponding data line of a plurality of data lines, and a corresponding initialization control line of a plurality of initialization control lines and configured to display an image according to a plurality of data signals transferred to the pixels;

a scan driver configured to transfer a plurality of scan signals to the plurality of scan lines;

a data driver configured to transfer a plurality of data signals to the plurality of data lines;

an initialization voltage controller configured to transfer a plurality of initialization control signals to the plurality of initialization control lines, to measure a threshold voltage variation for driving transistors of the plurality of pixels, and to determine a plurality of initialization voltages for the pixels in each of a plurality of regions;

an initialization voltage driver configured to apply one of a plurality of different initialization voltages to each of the pixels of each region; and a signal controller configured to generate and transfer control signals controlling operations of the scan driver, the data driver, and the initialization voltage controller and supply image data signals for the pixels to the data driver by processing an external image signal wherein the initialization voltage controller comprises:

a distribution measuring unit configured to measure a threshold voltage deviation of the driving transistors of the pixels by analyzing luminance from the display image with a sample initializing voltage and sample data applied to the pixels; and a voltage controller configured to group the pixels into regions according to the threshold voltage deviation for the driving transistor of the pixels, and to determine initialization voltages for pixels in each region.

2. The display device of claim 1, wherein each of the pixels is connected to a corresponding initialization voltage wire of a plurality of initialization voltage wires, and wherein the initialization voltage driver applies different initialization voltages for each region through the plurality of initialization voltage wires.

3. The display device of claim 1, wherein the initialization voltage driver applies the different initialization voltages for each region through the plurality of data lines, in the case where the predetermined region is each pixel unit.

4. The display device of claim 1, wherein the initialization voltage is applied to the gate electrode of the driving transistor of each of the pixels to initialize previously written data voltage.

5. The display device of claim 1, wherein the region consists of one or more pixels, one or more pixel lines, or one or more blocks.

6. The display device of claim 1, wherein the initialization voltage controller further comprises a storing unit configured to store luminance analysis information according to the sample initialization voltages and the sample data voltage received from the distribution measuring unit.

7. The display device of claim 1, wherein the initialization voltage controller further comprises an initialization control signal generator configured to receive a driving control signal from the signal controller and to generate and transfer a plurality of initialization control signals to a plurality of initialization control lines.

8. The display device of claim 1, wherein the distribution measuring unit measures actual luminance for the sample data voltage and determines a threshold voltage deviation of the driving transistor according to a difference between a target luminance and the actual luminance.

9. The display device of claim 1, wherein each of the plurality of pixels comprises:

an organic light emitting diode configured to emit light according to a driving current corresponding to a data signal, a driving transistor configured to transfer the driving current corresponding to the data signal to the organic light emitting diode, a switching transistor configured to transfer a data voltage according to the data signal to a gate electrode of the driving transistor, a threshold voltage compensation transistor configured to diode-connect a gate electrode and a drain electrode of the driving transistor in order to compensate the threshold voltage of the driving transistor, and an initialization transistor configured to transfer an initialization voltage from the initialization voltage driver to the gate electrode of the driving transistor in response to an initialization control signal transferred from the initialization voltage controller.

10. The display device of claim 9, wherein each of the pixels further includes a storage capacitor connected between the gate electrode of the driving transistor and a driving power voltage supply source of the pixel.

11. The display device of claim 1, wherein the voltage controller calculates different initialization voltages for the regions by fitting voltage values at end points of a compensation period.

12. The display device of claim 11, wherein each of the different initialization voltages is determined as any one value among an average value, a maximum value, a minimum value, and an intermediate value for a plurality of voltage values which fit the end points of the compensation period of the threshold voltages of the driving transistors of the plurality of pixels included in the region.

13. The display device of claim 1, wherein the initialization voltage driver applies the different initialization voltages according to a division form of the regions.

14. The display device of claim 1, wherein the initialization voltage driver includes a plurality of resistors connected in series, and divides different initialization voltage values calculated by the initialization voltage controller from a reference voltage to supply the divided different initialization voltage values to the plurality of pixels.

15. A method of driving a display device including a plurality of pixels each including an organic light emitting diode and a driving transistor transferring a driving current according to a data signal to the organic light emitting diode, the method comprising:

initializing a previous frame data voltage written at a gate electrode of the driving transistor;

compensating a threshold voltage of the driving transistor;

transferring the data signal to the driving transistor; and emitting light with the organic light emitting diode in response to the driving current according to the data signal, wherein the initializing comprises:

displaying a sample image by applying a sample initialization voltage and a sample data voltage to the pixels, measuring a threshold voltage deviation for the driving transistors of the pixels by analyzing luminance from the sample image, determining regions according to threshold voltage deviations for the driving transistor and calculating different initialization voltages for the pixels in each region; and applying the initialization voltages to the pixels by region.

16. The driving method of a display device of claim 15, wherein displaying the sample image and measuring of the threshold voltage deviation are repeated with different sample initialization voltages and sample data voltages.

17. The driving method of a display device of claim 15, wherein measuring the threshold voltage deviation comprises storing luminance analysis information analyzed from the sample image according to the sample initialization voltage and the sample data voltage.

18. The driving method of a display device of claim 15, wherein measuring the threshold voltage deviation comprises measuring actual luminance and determining target luminance for the sample data voltage and determining the threshold voltage deviation of the driving transistors according to a difference between the actual luminance and the target luminance.

19. The driving method of claim 15, wherein the region consists of one or more pixels, one or more pixel lines, or one or more blocks.

20. The driving method of a display device of claim 15, wherein in the calculating of the different initialization voltages comprises fitting voltage values at end points of a compensation period.

21. The driving method of a display device of claim 15, wherein in the applying of the initialization voltages, the different calculated initialization voltages are applied according to a division form of the regions.

22. The driving method of a display device of claim 15, wherein the regions consist of one or more pixels, and the calculated initialization voltages are applied through a data line of the pixels.

23. The driving method of a display device of claim 15, wherein a region consist of one or more pixel lines, at least one block including a plurality of pixel lines, and all pixels emitting light in one frame, and wherein the initialization voltages are applied through an initialization voltage wire connected to each pixel.

* * * * *